US008687988B2

(12) United States Patent
Yoshizawa

(10) Patent No.: US 8,687,988 B2
(45) Date of Patent: Apr. 1, 2014

(54) IMAGE FORMING APPARATUS FOR RETRYING FEED OF TRANSFER MATERIAL

(75) Inventor: Ryuichi Yoshizawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 520 days.

(21) Appl. No.: 12/783,858

(22) Filed: May 20, 2010

(65) Prior Publication Data

US 2010/0322651 A1 Dec. 23, 2010

(30) Foreign Application Priority Data

Jun. 19, 2009 (JP) ..... 2009-147006

(51) Int. Cl.
*G03G 15/16* (2006.01)

(52) U.S. Cl.
USPC ..... 399/66; 399/302; 399/308; 399/388

(58) Field of Classification Search
USPC ..... 399/38, 66, 121, 297, 301–303, 308, 399/388, 389, 16, 18, 21–23, 361, 381, 394
See application file for complete search history.

(56) References Cited

U.S. PATENT DOCUMENTS

| | | | | |
|---|---|---|---|---|
| 6,915,097 | B2 * | 7/2005 | Okamoto | 399/302 |
| 7,292,806 | B2 * | 11/2007 | Taguchi et al. | 399/127 |
| 7,587,150 | B2 * | 9/2009 | Taguchi | 399/53 |
| 7,773,902 | B2 * | 8/2010 | Takayanagi | 399/66 |
| 7,957,659 | B2 * | 6/2011 | Nada et al. | 399/66 |
| 8,139,967 | B2 * | 3/2012 | Nishikawa | 399/66 |
| 2008/0003031 | A1 * | 1/2008 | Tsuchiya et al. | 399/361 |

FOREIGN PATENT DOCUMENTS

| | | | |
|---|---|---|---|
| JP | 2000-351472 | A | 12/2000 |
| JP | 2001-337506 | A | 12/2001 |
| JP | 2004-37737 | A | 2/2004 |
| JP | 2004-037916 | A | 2/2004 |
| JP | 2005-249913 | A | 9/2005 |

OTHER PUBLICATIONS

English-language translation of paragraphs [0043] through [0045] of Japanese Patent Document No. 2005-249913 A.
Office Action mailed Mar. 29, 2013, in Japanese Application No. 2009-147006.

* cited by examiner

*Primary Examiner* — Hoan Tran
(74) *Attorney, Agent, or Firm* — Fitzpatrick, Cella, Harper & Scinto

(57) ABSTRACT

A detection unit is disposed between a feeding unit and a secondary transfer unit on a conveyance path, and detects a transfer material that is conveyed. A control unit, if the detection unit cannot detect the transfer material by a predetermined timing after a feeding operation by a feeding unit, moves the secondary transfer unit away from a intermediate transfer member, causes the intermediate transfer member to continue rotating, and causes the feeding unit to retry feeding of the transfer material.

17 Claims, 12 Drawing Sheets

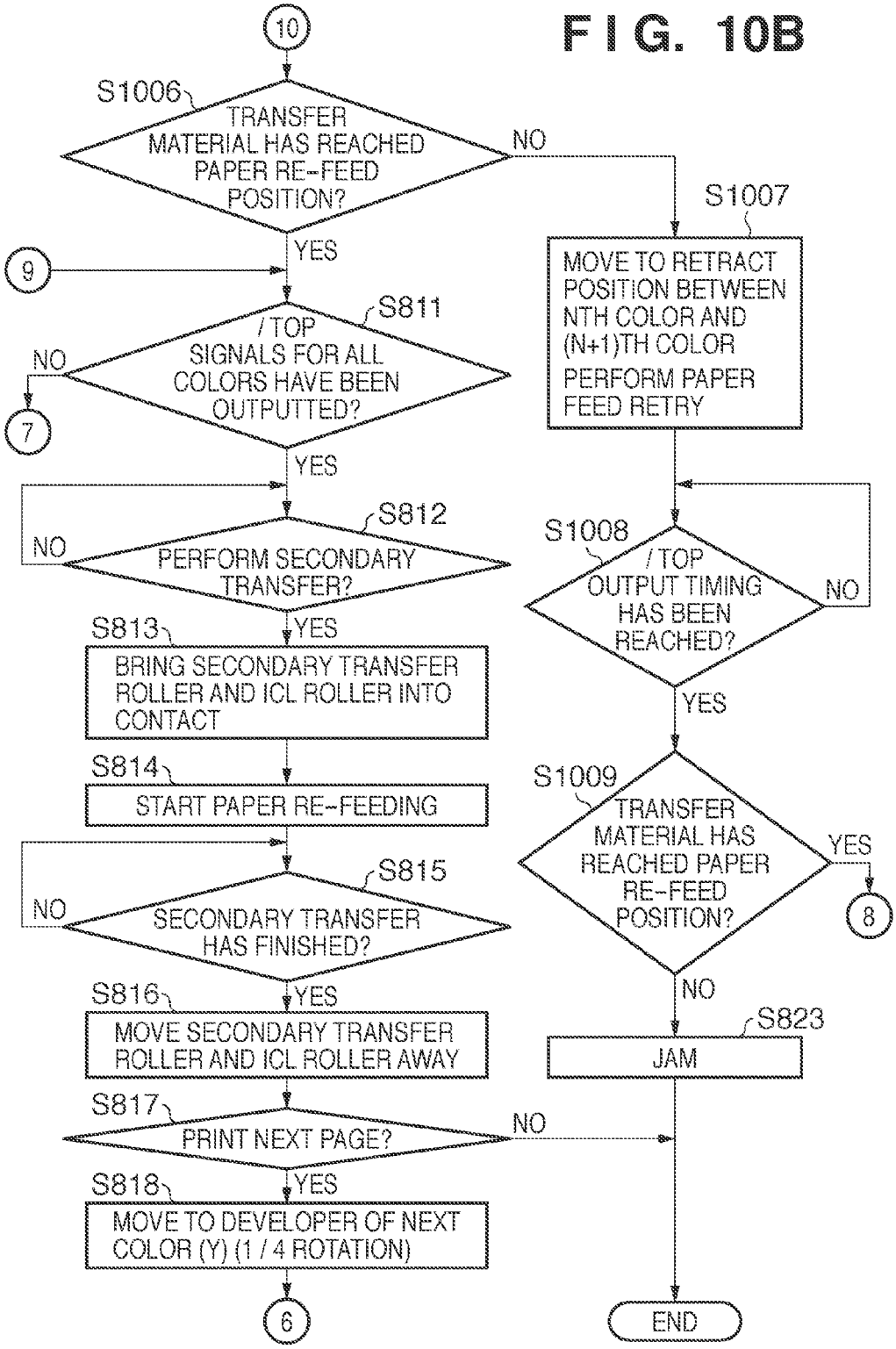
FIG. 10B
10
S1006
TRANSFER MATERIAL HAS REACHED PAPER RE-FEED POSITION?
NO
YES
S1007
MOVE TO RETRACT POSITION BETWEEN NTH COLOR AND (N+1)TH COLOR
PERFORM PAPER FEED RETRY
9
S811
/TOP SIGNALS FOR ALL COLORS HAVE BEEN OUTPUTTED?
NO
7
YES
S812
PERFORM SECONDARY TRANSFER?
NO
YES
S1008
/TOP OUTPUT TIMING HAS BEEN REACHED?
NO
YES
S813
BRING SECONDARY TRANSFER ROLLER AND ICL ROLLER INTO CONTACT
S814
START PAPER RE-FEEDING
S1009
TRANSFER MATERIAL HAS REACHED PAPER RE-FEED POSITION?
YES
8
S815
SECONDARY TRANSFER HAS FINISHED?
NO
YES
NO
S816
MOVE SECONDARY TRANSFER ROLLER AND ICL ROLLER AWAY
S823
JAM
S817
PRINT NEXT PAGE?
NO
YES
S818
MOVE TO DEVELOPER OF NEXT COLOR (Y) (1 / 4 ROTATION)
6
END

IMAGE FORMING APPARATUS FOR RETRYING FEED OF TRANSFER MATERIAL

BACKGROUND OF THE INVENTION

1. Field of the Invention

The present invention relates to an image forming apparatus that adopts an electrophotographic scheme or an electrostatic recording scheme.

2. Description of the Related Art

Generally, there are tandem type and rotary type color (multicolor) image forming apparatus that adopt an electrophotographic scheme or an electrostatic recording scheme. With the tandem type apparatus, before an intermediate transfer belt makes one full rotation, a toner image is formed on the intermediate transfer belt by a plurality of image forming units each of which is provided with a photosensitive drum (Japanese Patent Laid-Open No. 2000-351472). On the other hand, with the rotary type apparatus, a single photosensitive drum is shared by a development rotary provided with developers corresponding to plural colors, and an intermediate transfer belt is caused to make a plurality of full rotations, thereby forming a multicolor toner image on the intermediate transfer belt (Japanese Patent Laid-Open No. 2004-37916).

In particular, with the rotary type apparatus, a toner image is formed on the intermediate transfer belt, and thereafter feeding of a transfer material starts. Thus, if feeding of a transfer material fails, the toner image formed on the intermediate transfer belt cannot be transferred to a transfer material, which wastes toner.

Note that with both the tandem type apparatus and the rotary type apparatus, secondary transfer of a toner image can be performed at a desired position on a transfer material by matching the timing at which the toner image arrives at a secondary transfer position and the timing at which the transfer material arrives there. However, if a resist roller, which adjusts the timing at which the transfer material is conveyed in order to adjust the arrival timing of the transfer material, deteriorates, there are cases where the timing at which the transfer material arrives at a transfer position comes after the desired timing. Japanese Patent Laid-Open No. 2000-351472 discloses that the timing of resuming the conveyance of a transfer material, and its conveying speed are adjusted using a resist roller. Japanese Patent Laid-Open No. 2004-37916 discloses that the rotational speed of the intermediate transfer belt is adjusted.

However, in both of the inventions disclosed in Japanese Patent Laid-Open No. 2000-351472 and Japanese Patent Laid-Open No. 2004-37916, it is assumed that a transfer material is conveyed normally to the resist roller. Therefore, it is not possible to cope with the difference in the timing at which a transfer material reaches the resist roller that occurs because of the fall of the conveying capability of a pickup roller due to change with time, wear, and the like, the type and quality of the transfer material, and so on. Further, if the transfer material is not conveyed to the resist roller, a toner image cannot even be transferred. In this case, the toner image that is carried on the intermediate transfer belt is cleaned and discarded, and thus toner is consumed wastefully.

SUMMARY OF THE INVENTION

In view of this, a feature of the present invention is a solution for at least one of the above problems and other problems. A feature of the present invention is that even in the case where a transfer material is not conveyed to a resist roller by a desired timing, a paper feed retry is executed without wasting a toner image to the highest possible degree, for example. It should be noted that the other problems will be understood through the entire specification.

According to the present invention, an image forming apparatus comprises an image carrier, a developing unit, an intermediate transfer member, a secondary transfer unit, a feeding unit, a detection unit and a control unit. A latent image is formed on the image carrier. The developing unit develops the latent image using a developing material to form a developing material image of the image carrier. The intermediate transfer member on which primary transfer of the developing material image developed on the image carrier is performed. The secondary transfer unit comes into contact with the intermediate transfer member in order to perform secondary transfer, to a transfer material, of the developing material image that has undergone primary transfer to the intermediate transfer member. The feeding unit feeds the transfer material on which secondary transfer of the developing material image is to be performed to a conveyance path. The detection unit is disposed between the feeding unit and the secondary transfer unit on the conveyance path, and detects the transfer material that is conveyed. The control unit, if the detection unit cannot detect the transfer material by a predetermined timing after a feeding operation by the feeding unit, moves the secondary transfer unit away from the intermediate transfer member, causes the intermediate transfer member to continue rotating, and causes the feeding unit to retry feeding the transfer material.

According to the present invention, if feeding of a transfer material fails, a secondary transfer unit is moved away from an intermediate transfer member, and feeding is retried while the intermediate transfer member is making another full rotation. Thereby, even in the case where a transfer material is not conveyed to the resist roller by a desired timing, the paper feed retry can be executed without wasting a toner image to the highest possible degree.

Further features of the present invention will become apparent from the following description of exemplary embodiments with reference to the attached drawings.

BRIEF DESCRIPTION OF THE DRAWINGS

FIGS. 10A and 10B are flowcharts showing processing performed in Embodiment 3.

DESCRIPTION OF THE EMBODIMENTS

Figure 1:
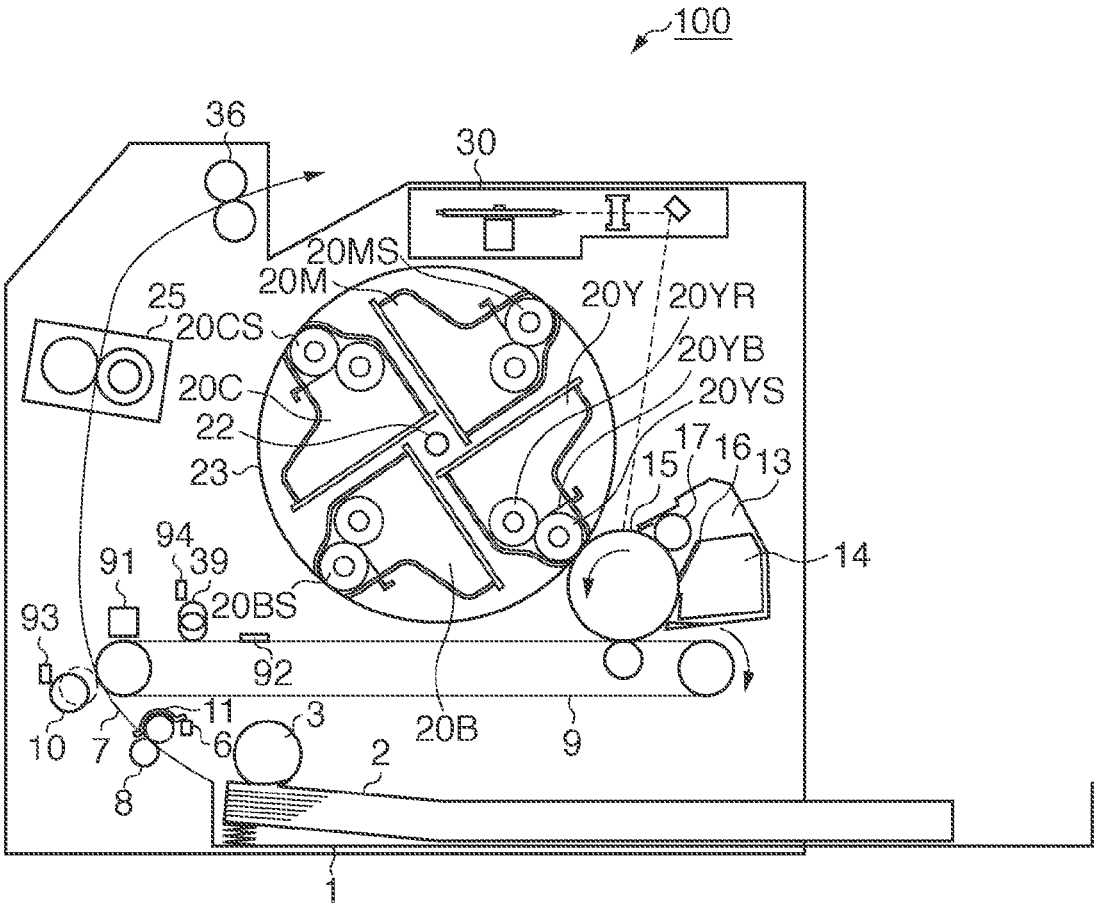
FIG. 1 is a schematic cross-sectional view of an image forming apparatus according to an embodiment.

According to FIG. 1, an image forming apparatus 100 is a so-called rotary type image forming apparatus. Note that in the present embodiment, in the case where a transfer material is not conveyed, an intermediate transfer member is caused to make one full rotation without secondary transfer of a toner image due to having moved a secondary transfer member away from the intermediate transfer member, and a paper feed retry is performed during this period. Note that an image forming apparatus can be realized as a printing apparatus, a printer, a copier, a multi-function peripheral, or a facsimile. Further, a transfer material may be referred to as a recording material, a recording medium, paper, a sheet, or transfer paper.

Image Carriage Unit

A drum unit 13 is constituted by a photosensitive drum 15 and a container 14 that form one unit. The photosensitive drum 15 is an example of a rotatable image carrier on which an electrostatic latent image is formed, and is assumed here to be a drum type electrophotographic photosensitive member. The container 14 is a container of a cleaning apparatus that also serves as a holder of the photosensitive drum 15. Around the photosensitive drum 15, a cleaner blade 16 and a primary charger 17 are disposed. The photosensitive drum 15 rotates in the arrow direction according to an image formation operation.

Charger

The primary charger 17 is a conductive roller using a contact charging scheme. By bringing the conductive roller to which voltage (hereinafter, also referred to as bias) is applied into contact with the photosensitive drum 15, the surface of the photosensitive drum 15 is charged uniformly. After that, a scanner unit 30 exposes the photosensitive drum 15, thereby forming an electrostatic latent image thereon.

Cleaner

The electrostatic latent image formed on the photosensitive drum 15 is developed by a developer so as to be a visible image (toner image). Primary transfer of the toner image from the photosensitive drum 15 to an intermediate transfer member 9 is performed. The position where the photosensitive drum 15 and the intermediate transfer member 9 are in contact, in other words, the position where primary transfer is executed is a primary transfer position. A cleaner cleans toner remaining on the photosensitive drum 15 that was not transferred to the intermediate transfer member 9. The toner removed from the photosensitive drum 15 is stored in the container 14.

Developing Unit

A development rotary 23 is an example of a developing unit that develops an electrostatic latent image to a visible image using developing materials. Further, the development rotary 23 is an example of a developing unit provided with M developers that develop electrostatic latent images using M colors of developing materials. Here, it is assumed that the development rotary 23 is provided with four developers 20Y, 20M, 20C, and 20B. These developers respectively develop latent images using different colors of developing materials (yellow, magenta, cyan, black). The developers 20Y, 20M, 20C, and 20B are respectively provided with developing rollers (hereinafter, also referred to as developing sleeves) 20YS, 20MS, 20CS, and 20BS. Further, the developer 20Y is provided with a coating roller 20YR and a blade 20YB. The other developers have similar configurations.

The development rotary 23 rotates about an axis 22. Thereby, the developer that is to develop a latent image is selected. That is, a desired developer stops so as to face the photosensitive drum 15 (the stop position is referred to as a development position). Further, positioning is performed such that the developing sleeve with which this developer is provided has a minute gap with respect to the photosensitive drum 15.

At the time of color image formation, the development rotary 23 rotates ¼ of a full rotation every time the intermediate transfer member 9 makes one full rotation, and thereby the developer that performs development is switched. Developing processing is executed by the yellow developer 20Y, the magenta developer 20M, the cyan developer 20C, and the black developer 20B, in the stated order. By the intermediate transfer member 9 making four full rotations, primary transfer of visible images made using yellow, magenta, cyan, and black toner is sequentially performed. As a result, a multicolor visible image is formed on the intermediate transfer member 9.

In FIG. 1, the yellow developer 20Y is positioned at the development position. Toner in the container of the developer 20Y is fed to the coating roller 20YR. The outer surface of the developing sleeve 20YS that rotates clockwise is coated with a thin toner layer by the coating roller 20YR that rotates clockwise and the blade 20YB. An electric charge is given to the toner due to frictional electrification. Application of developing voltage (also referred to as developing bias) to the developing sleeve 20YS facilitates toner development. Development is performed similarly in the case of the magenta developer 20M, the cyan developer 20C, and the black developer 20B.

Intermediate Transfer Member

The intermediate transfer member 9 is a belt-shaped or cylindrical image carrier to which primary transfer of a visible image from another image carrier is performed. When performing color image formation, multiple transfer from the photosensitive drum 15 to the intermediate transfer member 9 is performed four times. The intermediate transfer member 9 rotates in the arrow direction, and conveys a transfer material 2 sandwiched between the intermediate transfer member 9 and the secondary transfer member to which transfer bias has been applied (hereinafter, referred to as "secondary transfer roller 10"). In this way, the toner image on the intermediate transfer member 9 is transferred to the transfer material 2 at one time. Note that the position where the intermediate transfer member 9 and the secondary transfer roller 10 are in contact, that is, the position where secondary transfer is executed is a secondary transfer position. An HP mark 92 used as the reference for circumference measurement of the intermediate transfer member 9 and for the image start timing for the colors of images, and an optical sensor 91 for detecting the HP mark are provided in the non image region of the outer surface of the intermediate transfer member 9. It should be noted that HP is an abbreviation for home position.

Paper Feed Unit

A paper feed unit is a unit that feeds the transfer material 2 to an image forming unit. A cassette 1 stores a plurality of the transfer materials 2. A paper feed roller 3 is driven to rotate according to an image formation operation, separates the transfer materials 2 in the cassette 1 one by one, and feeds the transfer material to a conveyance path. The paper feed roller 3 is an example of a feeding unit that feeds, to the conveyance path, a transfer material to which secondary transfer of a visible image is to be performed. On the conveyance path, a resist roller 8 is provided between the paper feed roller 3 and the secondary transfer roller. A shutter 11 with which the resist roller 8 is provided corrects the skew of the transfer material 2. The shutter 11 is rotated by the leading edge of the transfer material 2. A leading edge detection sensor 6 detects the transfer material 2 by detecting rotation of the shutter 11. The leading edge detection sensor 6 is disposed between the feeding unit and the secondary transfer unit on the conveyance path, and is an example of a detection unit that detects a transfer material that has been conveyed along the conveyance path. The resist roller 8 performs a non-rotational operation for causing the transfer material 2 to stop and wait at a paper re-feed waiting position 7 during image forming operation, and a rotational operation for conveying the transfer material 2 to the intermediate transfer member 9, based on the image formation timing and the timing at which the transfer material 2 is detected by the leading edge detection sensor 6. Thereby, the timing at which a toner image reaches the secondary transfer position, and the timing at which the transfer material 2 reaches the secondary transfer position are adjusted, and both the timings are synchronized. Note that the resist roller 8 is an example of a conveying unit that stops after conveying a transfer material to a predetermined waiting position if the transfer material is detected by the detection unit, and resumes conveying the transfer material in response to an instruction to resume conveyance.

Transfer Unit

The secondary transfer roller 10 is an example of the secondary transfer unit that performs secondary transfer of a visible image carried on the intermediate transfer member to a transfer material. The secondary transfer roller 10 is swingable, for example, and can come into contact with, or move away from the intermediate transfer member 9. While four colors of toner images are formed on the intermediate transfer member 9 (specifically, while the intermediate transfer member 9 is making four full rotations), the secondary transfer roller 10 is moved away from the intermediate transfer member 9 so that the toner images do not become deteriorated. Specifically, the secondary transfer roller 10 retracts or waits at the position shown by a solid line. When four colors of toner images are transferred and superimposed onto the intermediate transfer member 9, the secondary transfer roller 10 comes into contact with the intermediate transfer member 9 in accordance with the timing at which the color image is transferred to the transfer material 2. Specifically, the secondary transfer roller 10 is moved to the position shown by a dashed line by a cam member 93. At this time, transfer voltage (also referred to as transfer bias) is applied to the secondary transfer roller 10. Since the intermediate transfer member 9 and the secondary transfer roller 10 are respectively rotationally driven, secondary transfer is performed with respect to the transfer material 2 that is in the state of being sandwiched therebetween, and at the same time, the transfer material 2 is conveyed towards a fixing unit 25. The cam member 93, a driving control unit 217 that drives this, and the like are examples of a first contact/moving away mechanism that brings the secondary transfer unit into contact with the intermediate transfer member or moves the secondary transfer unit away from the intermediate transfer. In the fixing unit 25, an unfixed toner image is fixed onto the transfer material 2. After that, the transfer material 2 is discharged outside the apparatus by discharge rollers 36.

After secondary transfer of the toner image from the intermediate transfer member 9 to the transfer material 2 is performed, residual toner that remains on the intermediate transfer member 9 is charged by a charging roller (referred to as an ICL roller 39) to a polarity opposite to the charge polarity. After charging of the residual toner finishes, the ICL roller 39 is moved away from the intermediate transfer member 9. Note that when primary transfer of four colors of toner images to the intermediate transfer member 9 is performed, the ICL roller 39 is moved away from the intermediate transfer member 9. Note that the state of the secondary transfer roller 10 and the ICL roller 39 can be switched between the state of being in contact with the intermediate transfer member 9 and the state of being moved away therefrom by a solenoid that switches whether or not to transmit power from a motor to a roller contact/moving away cam 94, for example. Reverse transfer of the residual toner that has been charged by the ICL roller 39 to the photosensitive drum 15 is electrostatically performed at the primary transfer position, and the residual toner is collected in the container 14 by the cleaner blade 16. Thus, the ICL roller 39 is provided between the secondary transfer unit and the image carrier, and is an example of a bias application unit that applies, to the intermediate transfer member, bias for cleaning the developing material that remains on the intermediate transfer member after secondary transfer is executed by the secondary transfer unit. Further, cams, a solenoid, the driving control unit 217 that drive these, and the like are examples of a second contact/moving away mechanism that brings the bias application unit into contact with the intermediate transfer member or moves the bias application unit away from the intermediate transfer member.

Control Unit

Figure 2:
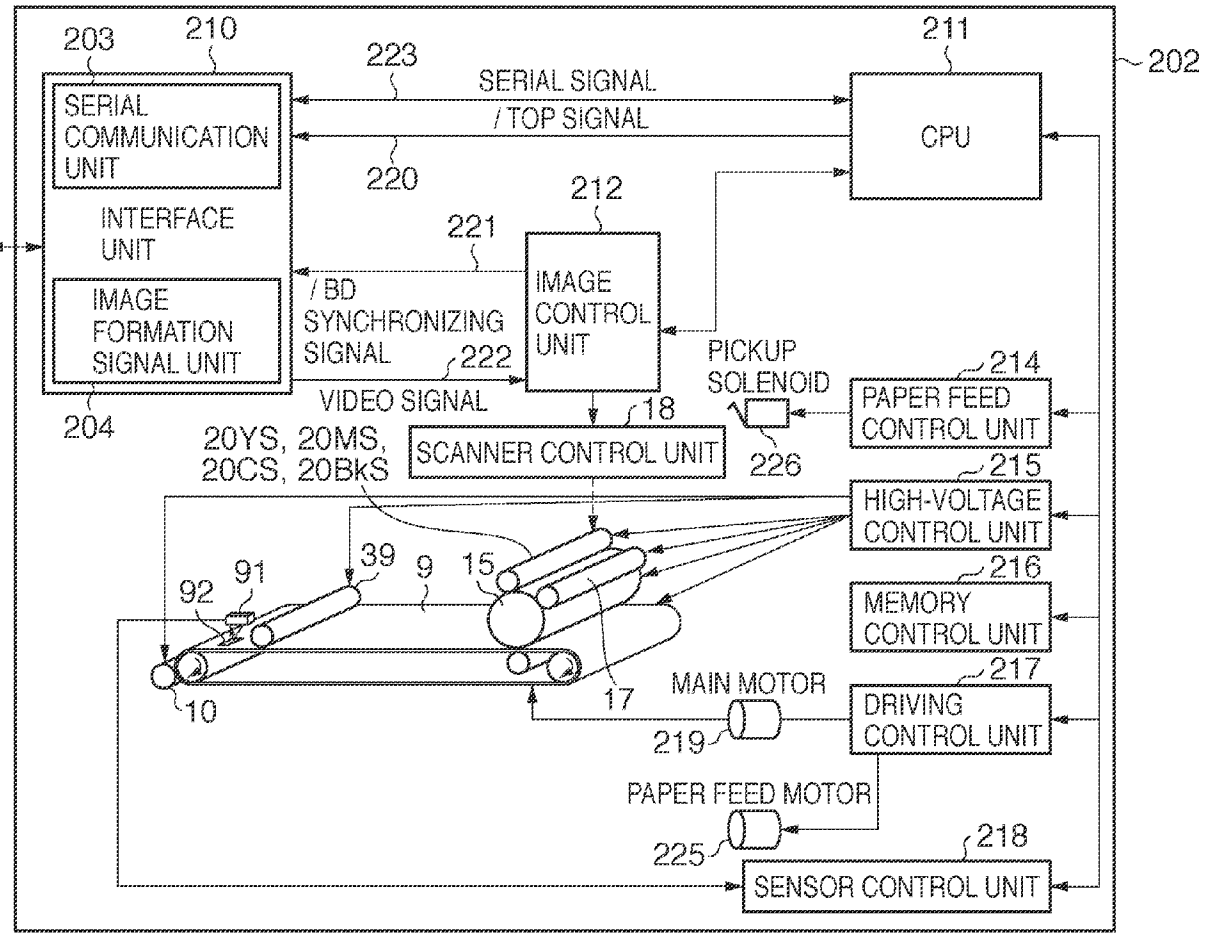
FIG. 2 is a block diagram illustrating a control unit of the image forming apparatus.

According to FIG. 2, a controller unit 201 receives a print job from a host computer 200, and executes various image processing such as rendering of image data into bitmap data. An engine control unit 202 is a unit that performs overall control of the engine of the image forming apparatus 100. An interface unit 210 is provided with a serial communication unit 203 and an image formation signal unit 204. The serial communication unit 203 executes serial communication with a CPU 211 via a serial communication line 223. Thereby, the controller unit 201 transmits a command, or receives information on an engine status, for instance. The CPU 211 transmits a /TOP signal 220 used as the reference for image formation. The image formation signal unit 204 starts transmitting a video signal to an image control unit 212 using the /TOP signal 220 as a reference. The /TOP signal 220 indicates the beginning of a page. The image control unit 212 transmits a /BD synchronizing signal 221 from a scanner control unit 18. Every time the /BD synchronizing signal 221 is received, the image formation signal unit 204 transmits a video signal 222 corresponding to one line. The image control unit 212 transfers the video signal 222 to the scanner control unit 18. Various signal processing such as PWM modulation may be applied to the video signal 222. The /TOP signal 220 functions as a vertical synchronizing signal, and the /BD synchronizing signal 221 functions as a horizontal synchronizing signal.

The CPU 211 performs overall control of the engine. For example, the CPU 211 detects the HP mark 92 on the intermediate transfer member 9 using the optical sensor 91, which is a part of a sensor unit 218. Note that the CPU 211 is an example of a control unit that, if the detection unit cannot detect a transfer material by a predetermined timing after a feeding operation by the feeding unit, causes the secondary transfer unit to move away from the intermediate transfer member by controlling the first contact/moving away mechanism, and also causes the intermediate transfer member to continue rotating, and causes the feeding unit to retry feeding a transfer material. Further, the CPU 211 functions so as to cause the bias application unit to move away from the intermediate transfer member by controlling the second contact/moving away mechanism if the detection unit cannot detect a transfer material by a predetermined timing.

The driving control unit 217 controls a main motor 219 and a paper feed motor 225 based on an instruction from the CPU 211. The main motor 219 drives the intermediate transfer member 9, the photosensitive drum 15, and the development rotary 23. The paper feed motor 225 drives the resist roller 8.

A paper feed control unit 214 controls a pickup solenoid 226 based on an instruction from the CPU 211. The paper feed roller 3 is driven by the paper feed motor 225 connected via a clutch. The pickup solenoid 226 drives this clutch. The clutch is connected by attraction of the pickup solenoid 226, and thus the paper feed roller 3 makes one full rotation. Thereby, the transfer material 2 stored in the cassette 1 is picked up, and fed to the conveyance path.

A high-voltage control unit 215 applies secondary transfer bias to the secondary transfer roller 10, applies reverse bias to the ICL roller 39, and applies charging bias to the charger, in response to instructions from the CPU 211. A memory control unit 216 controls a nonvolatile memory that has stored therein a control program, a ROM, and a RAM.

Relationship between Development Position and Development Retract Position

Figure 3:
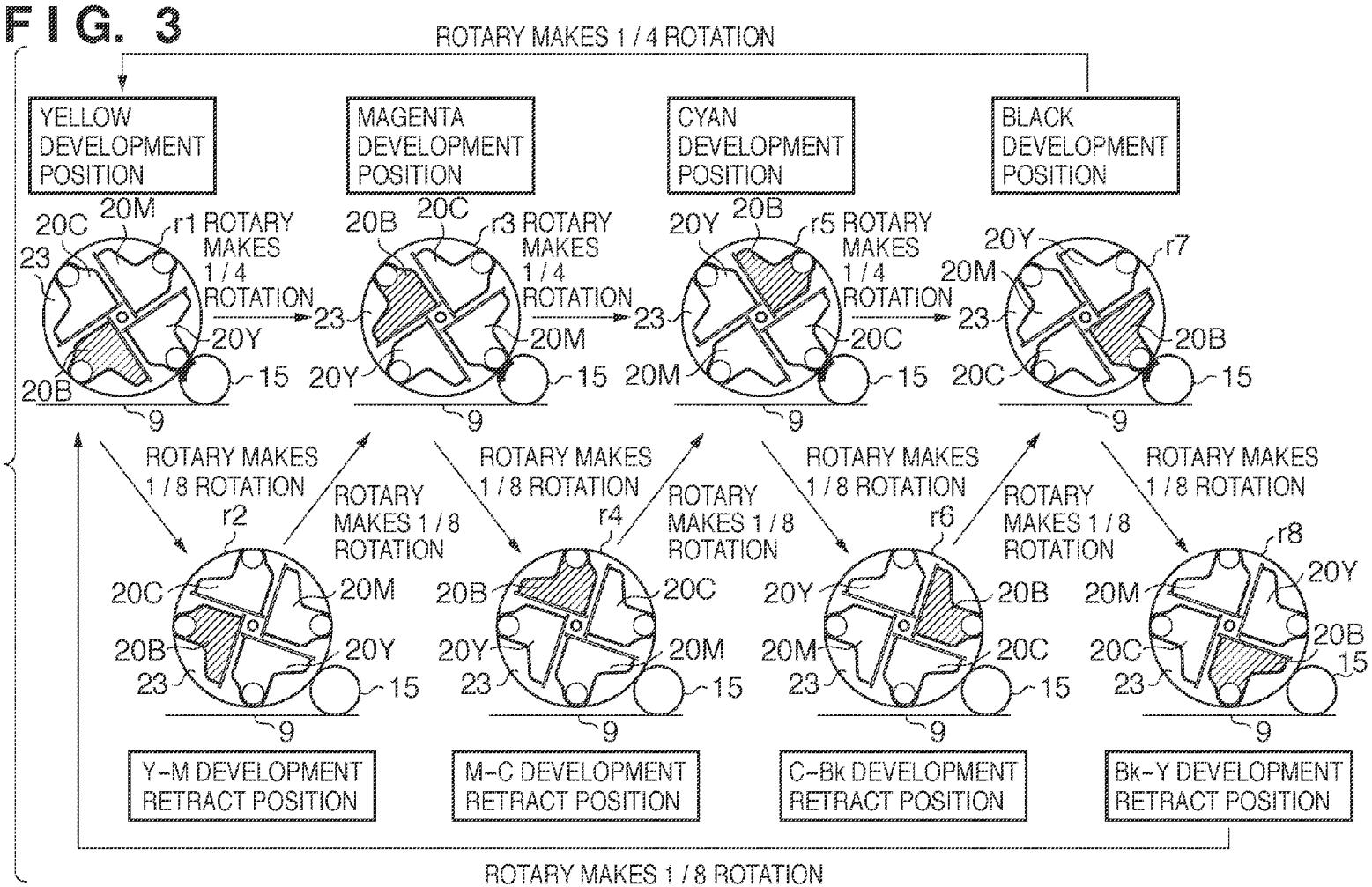
FIG. 3 is a diagram illustrating the state of a development rotary 23.

According to FIG. 3, the development rotary 23 stops at eight positions (stop positions) if the development rotary 23 is a four color development rotary. FIG. 3 shows the state where the developer of each color is stopped at the development position (r1, r3, r5, r7), and the state where all the developers are at positions other than the development position (hereinafter, referred to as "development retract position") (r2, r4, r6, r8). In this way, one of the developers develops an electrostatic latent image, and thereafter the development rotary 23 rotates to a position where none of the developers are in contact with the image carrier.

In a state where a certain developer is at the development position, if the development rotary 23 rotates ¼ of a full rotation, a developer of the next color reaches the development position. For example, in the state where the yellow developer 20Y is at the development position (r1), if the development rotary 23 rotates ¼ of a full rotation, the magenta developer 20M moves to the development position (r3). By the development rotary 23 further rotating ¼ of a full rotation, the cyan developer 20C moves to the development position (r5). By the development rotary 23 further rotating ¼ of a full rotation, the black developer 20B reaches the development position (r7). Normally, the development rotary 23 rotates ¼ of a full rotation at one time, when performing color image formation.

In the state where a certain developer is at the development position, if the development rotary 23 rotates ⅛ of a full rotation, that developer moves to a development retract position. By the development rotary 23 further rotating ⅛ of a full rotation, a developer of the next color reaches the development position. For example, in the state where the yellow developer 20Y is at the development position (r1), if the development rotary 23 rotates ⅛ of a full rotation, a portion positioned in the middle between the yellow developer 20Y and the magenta developer 20M comes to the development position. This is referred to as a Y-M development retract position (r2). By the development rotary 23 further rotating ⅛ of a full rotation from this position, the magenta developer 20M moves to the development position (502) (r3).

Basic Operation

Figure 4:
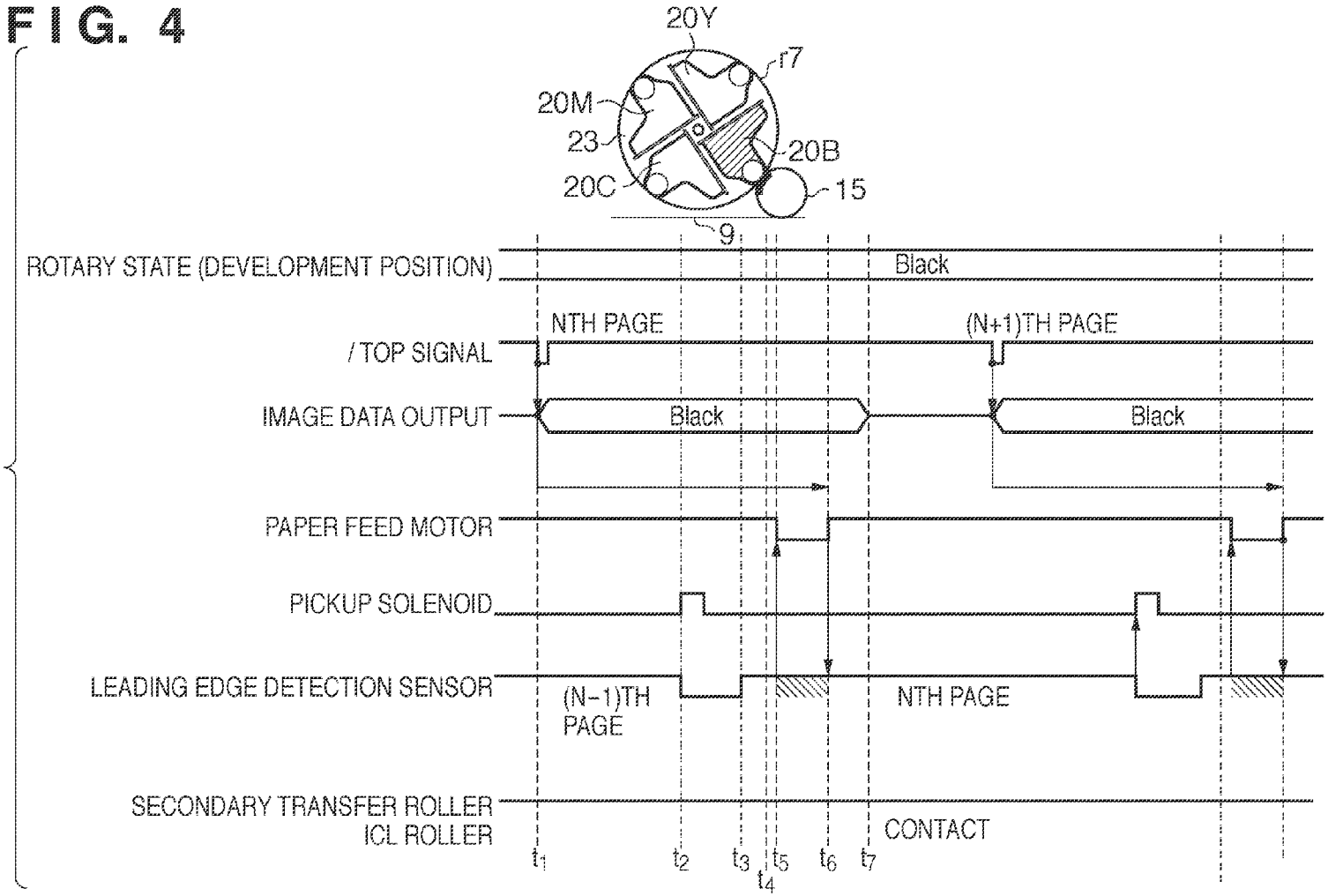
FIG. 4 is a timing chart for unicolor image formation for illustrating a problem addressed by the present invention.

The following describes black unicolor image formation (thereafter, referred to as "monochrome image formation") with reference to FIG. 4. When performing monochrome image formation, the black developer 20B continuously executes image formation in the state of being fixed at the development position (r7). Further, the secondary transfer roller 10 and the ICL roller 39 continue being in contact with the intermediate transfer member 9.

The CPU 211 outputs the /TOP signal at an image formation timing (t1). The controller unit 201 outputs image data in synchronization with the /TOP signal. At a timing (t2) when the trailing edge of the proceeding sheet of paper has passed the leading edge detection sensor 6, the CPU 211 starts a paper feed operation by attraction of the pickup solenoid 226. When the leading edge detection sensor 6 detects the transfer material 2 that has been picked up (t3), the CPU 211 conveys the transfer material 2 to the paper re-feed waiting position 7, and thereafter stops the paper feed motor 225 (t5). The CPU 211 restarts the paper feed motor 225 at a secondary transfer timing (t6), and conveys the transfer material 2 that is waiting at the paper re-feed waiting position 7 towards the secondary transfer position. At the secondary transfer position in the conveyance path, a toner image on the intermediate transfer member 9 is transferred to the transfer material 2 by the secondary transfer roller 10. If the leading edge detection sensor 6 does not detect that the transfer material 2 has reached the paper re-feed waiting position 7 by the secondary transfer timing (t6) determined in advance, the CPU 211 determines that a jam has occurred, and interrupts image formation. In FIG. 4, the secondary transfer timing (t6) corresponds to a jam determination timing at which the CPU 211 determines whether or not a jam has occurred.

In the case of monochrome image formation, the period from the first paper feed start (t2) to the secondary transfer timing (t6) is short. Accordingly, a paper feed retry cannot be performed by the secondary transfer timing (t6). Since the secondary transfer timing (t6) comes between a first paper feed retry determination timing (t4) and a second paper feed retry determination timing (t7), with the mere fact that the first paper feed operation was not able to be performed normally, the CPU 211 will determine that a jam has occurred. Note that the paper feed retry determination timings are the timings at which the transfer material 2 is considered to reach the leading edge detection sensor 6, and have been determined in advance.

In view of this, in the present invention, if the transfer material 2 is not conveyed to the paper re-feed waiting position 7 by the secondary transfer timing (t6), the CPU 211 performs control such that the secondary transfer roller 10 and the ICL roller 39 are moved away from the intermediate transfer member 9. Accordingly, secondary transfer of the toner image that is carried on the intermediate transfer member 9 is not performed at the secondary transfer position, and the toner image passes there. The intermediate transfer member 9 makes another full rotation (rotation without transferring the toner image), and when the toner image reaches the secondary transfer position again, secondary transfer is performed. Specifically, while the intermediate transfer member 9 rotates without transferring the toner image in the state of carrying the toner image thereon, the CPU 211 executes a paper feed retry. Accordingly, it is possible to execute a paper feed retry without discarding the toner image that is once formed on the intermediate transfer member 9.

Figure 5:
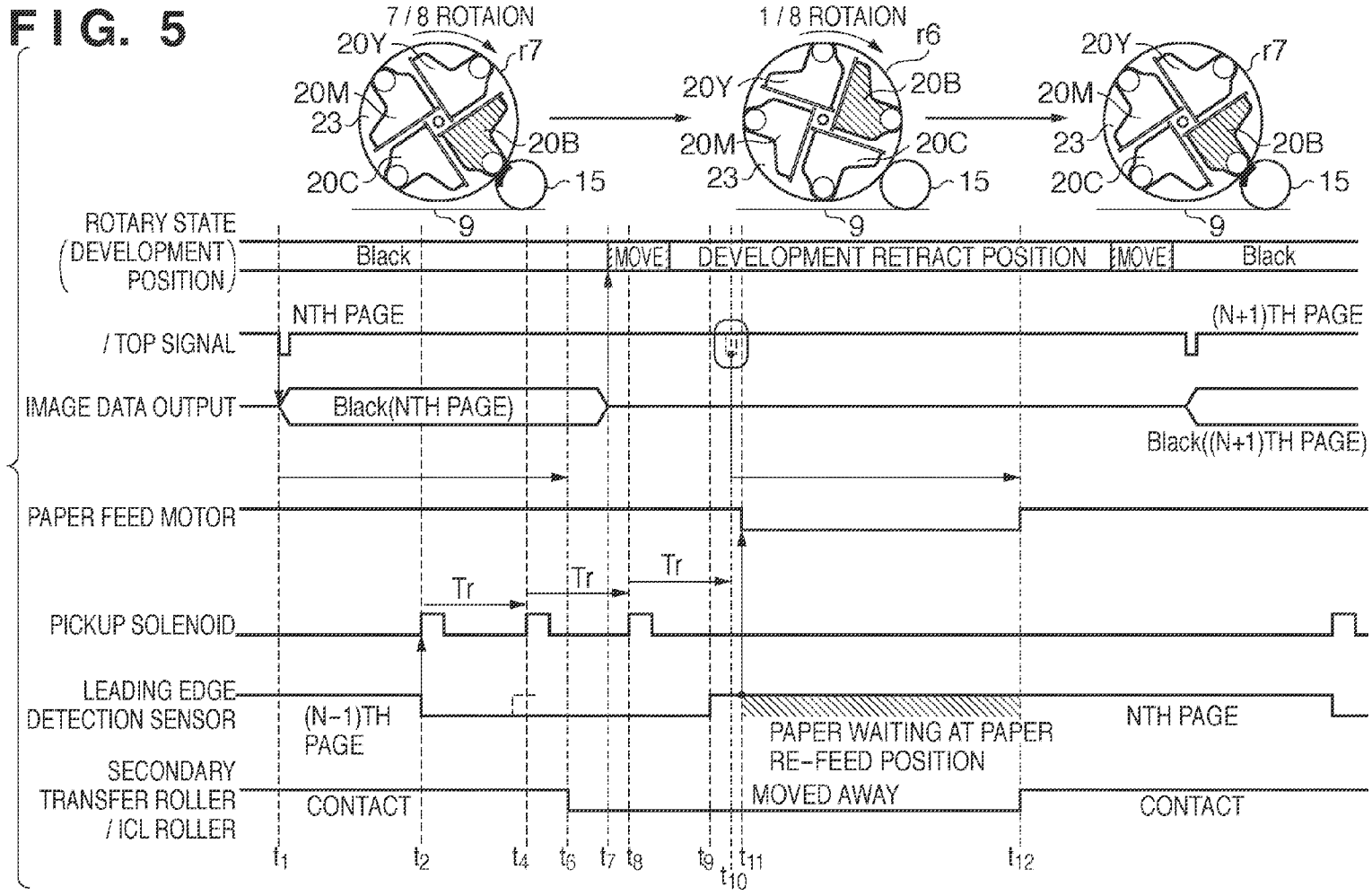
FIG. 5 is a timing chart showing unicolor image formation according to Embodiment 1.

Next, a description is given with reference to FIG. 5. The CPU 211 outputs the /TOP signal at an image formation timing (t1). The controller unit 201 outputs image data in synchronization with the /TOP signal (t1).

After that, at a timing (t2) when the trailing edge of the proceeding sheet of paper has passed the leading edge detection sensor 6, the CPU 211 starts a paper feed operation by attraction of the pickup solenoid 226. If the leading edge detection sensor 6 cannot detect the transfer material 2 by a paper feed retry determination timing (t4, t8), the CPU 211 implements a paper feed retry (t4, t8). The paper feed retry is finished when the leading edge detection sensor 6 detects the transfer material 2 while performing a paper feed retry.

If the transfer material 2 has not reached the paper re-feed waiting position 7 by a secondary transfer timing (t6) for an Nth page, the CPU 211 causes the secondary transfer roller 10 and the ICL roller 39 to move away from the intermediate transfer member 9. Accordingly, the toner image on the intermediate transfer member 9 passes through the secondary transfer position without being transferred. At the timing when development for the Nth page finishes (development finish timing (t7)), the CPU 211 causes the development rotary 23 to rotate ⅞ of a full rotation in a forward direction, or rotate ⅛ of a full rotation in a reverse direction. Accordingly, the black developer 20B moves to a C-Bk development retract position. At a timing (t12) when a toner image on the Nth page on the intermediate transfer member 9 reaches the secondary transfer position again by making one full rotation, if the transfer material 2 is waiting at the paper re-feed waiting position 7, the CPU 211 brings the secondary transfer roller 10 and the ICL roller 39 into contact with the intermediate transfer member 9. Furthermore, the CPU 211 drives the paper feed motor 225 so as to re-feed the transfer material 2, and conveys the transfer material 2 toward the secondary transfer position (t12). The timing t12 is the secondary transfer timing when a paper feed retry is executed, and also corresponds to the jam determination timing at which it is determined whether or not a jam has occurred. Before the toner image on the intermediate transfer member 9 that has once passed through without being transferred reaches the secondary transfer position again, the CPU 211 executes a paper feed retry. At the jam determination timing (t12), if it is not detected that the transfer material 2 has reached the paper re-feed waiting position 7, the CPU 211 determines that a jam has occurred, and interrupts the image formation operation. Note that according to FIG. 5, the CPU 211 detects the transfer material 2 due to the third paper feed retry (t9), determines that the paper feed retry has succeeded (t10), and stops the transfer material 2 at the paper re-feed waiting position 7 (t11).

Figure 6:
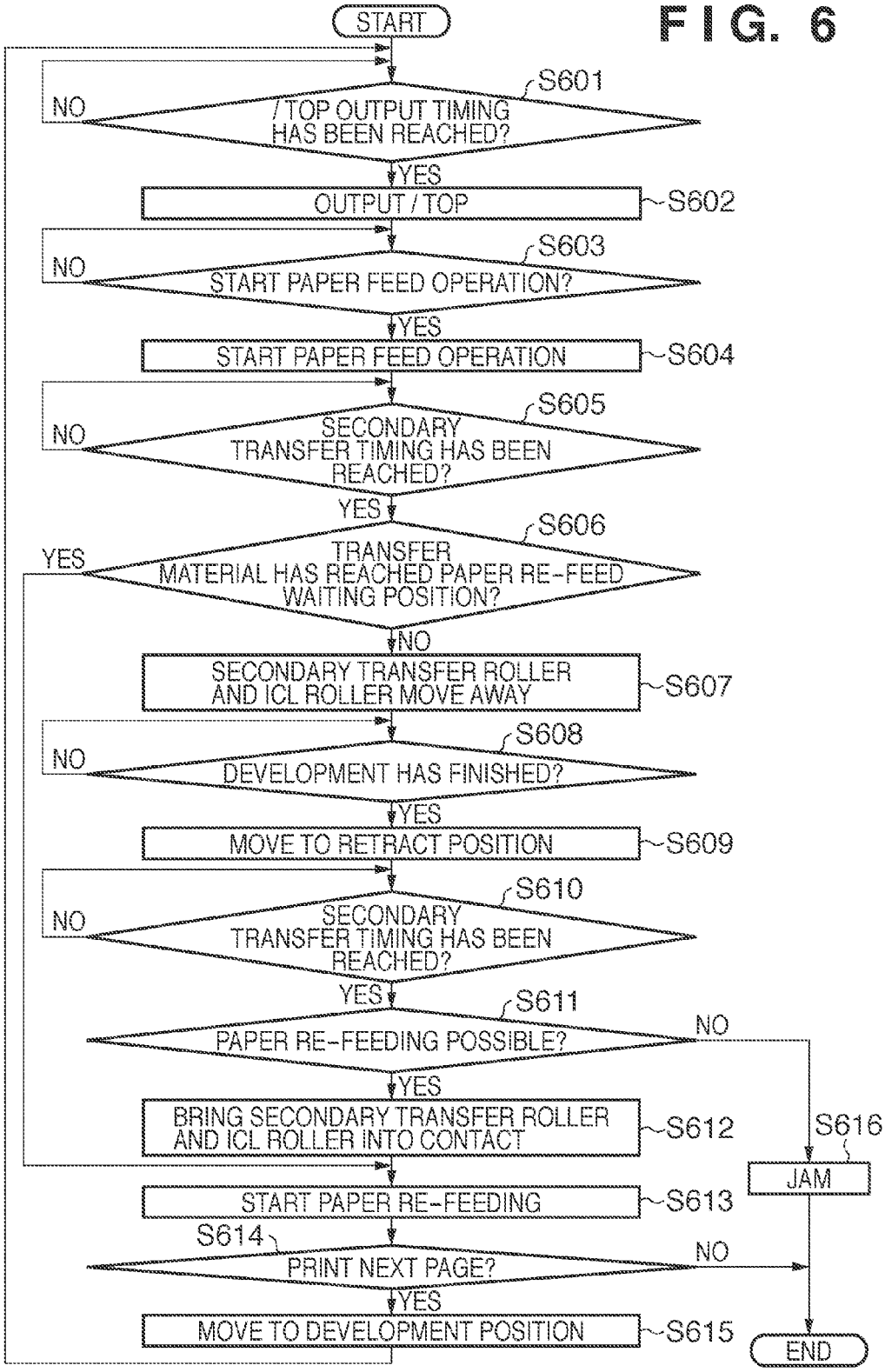
FIG. 6 is a flowchart showing processing performed in Embodiment 1.

Next, a series of processing is described with reference to FIG. 6. In S601, the CPU 211 determines whether or not a predetermined /TOP output timing has been reached. Normally, the /TOP output timing is a timing at which the CPU 211 that has received a command for starting image formation from the controller unit 201 causes the units of the engine to transition to a state where image formation is possible. That is, the /TOP output timing is a timing at which image formation is ready to be performed. When the /TOP output timing has been reached, the processing proceeds to S602. In S602, the CPU 211 outputs the /TOP signal 220 to the controller unit 201. In S603, the CPU 211 determines whether or not a paper feed operation start timing has been reached. The paper feed operation start timing is a timing at which the trailing edge of the proceeding sheet of paper has passed the leading edge detection sensor 6. If the paper feed operation start timing has been reached, the processing proceeds to S604. In S604, the CPU 211 starts a paper feed operation.

In S605, the CPU 211 determines whether or not the secondary transfer timing has been reached. If the secondary transfer timing has been reached, the processing proceeds to S606. In S606, the CPU 211 determines whether or not the transfer material 2 has reached the paper re-feed waiting position 7. For example, the CPU 211 determines whether or not the leading edge detection sensor 6 has detected the transfer material 2. If the transfer material 2 has not reached the paper re-feed waiting position 7, the processing proceeds to S613, and if the transfer material 2 has reached the paper re-feed waiting position 7, the processing proceeds to S607.

In S607, the CPU 211 drives a motor (not shown) via the driving control unit 217, and thereby causes the secondary transfer roller 10 and the ICL roller 39 to move away from the intermediate transfer member 9. Accordingly, a toner image passes through the secondary transfer position without being transferred. In S608, the CPU 211 determines whether or not development for the Nth page has finished. For example, the CPU 211 determines that development for the Nth page has finished when reception of image data of the Nth page has finished. If the development of the Nth page has finished, the processing proceeds to S609. In S609, the CPU 211 controls a motor (not shown) via the driving control unit 217 so as to cause the development rotary 23 to rotate ⅞ of a full rotation in the forward direction (or rotate ⅛ of a full rotation in a reverse direction). Accordingly, the black developer 20B moves to the C-Bk development retract position (r6). Accordingly, it is possible to suppress a developer being worn out during a paper feed retry.

In S610, the CPU 211 determines whether or not the secondary transfer timing has been reached. For example, the CPU 211 determines whether or not the toner image on the intermediate transfer member 9 has reached the secondary transfer position again. Normally, this timing is determined using the detection timing of detecting the HP mark 92 as the reference. If the secondary transfer timing has been reached, the processing proceeds to S611.

In S611, the CPU 211 determines whether or not the transfer material 2 is waiting at the paper re-feed waiting position 7. For example, if the leading edge detection sensor 6 has detected the transfer material 2, the CPU 211 determines that the transfer material 2 is waiting at the paper re-feed waiting position 7. If the transfer material 2 can be re-fed, the processing proceeds to S612. In S612, the CPU 211 gives, to the driving control unit 217, an instruction to bring the secondary transfer roller 10 and the ICL roller 39 into contact with the intermediate transfer member 9. In S613, the CPU 211 executes re-feeding of the transfer material 2 that is waiting at the paper re-feed waiting position. For example, the CPU 211 resumes driving of the paper feed motor 225 via the driving control unit 217 so as to convey the transfer material 2 to the secondary transfer position. Accordingly, secondary transfer of the toner image on the intermediate transfer member 9 to the transfer material 2 is performed.

In S614, the CPU 211 determines whether or not a next page on which image formation is to be performed exists. For example, the CPU 211 determines whether or not a command for giving an instruction to execute image formation on the next page has been received from the controller unit 201. If the next page exists, the processing proceeds to S615. In S615, the CPU 211 causes the development rotary 23 to rotate ⅛ of a full rotation, and thus moves the black developer 20B that was retracted during the paper feed retry to the development position again. After that, the processing returns to S601, and the CPU 211 continues the image formation operation with respect to the next page.

Note that if it is determined in S611 that the transfer material 2 has not reached the paper re-feed waiting position 7 before the toner image on the intermediate transfer member 9 that passed through the secondary transfer position reaches the secondary transfer position again, the processing proceeds to S616. In S616, the CPU 211 determines that a jam has occurred, and interrupts the image formation operation.

According to the present invention, if feeding of a transfer material fails, the secondary transfer unit is moved away from the intermediate transfer member, and feeding is retried while the intermediate transfer member is making another full rotation. For example, even in the case where the transfer material 2 is not conveyed to the resist roller 8 by a desired timing, a feeding retry can be executed without wasting a toner image to the highest possible degree. If feeding of a transfer material succeeds by retrying feeding of a transfer material, the toner image on the intermediate transfer member can be transferred to the transfer material, and thus toner is not wasted. Further, by moving a developer to a retract position, it is possible to suppress the wear of the developer. Note that by retracting other members that are in contact with the intermediate transfer member 9, such as the ICL roller 39, a transfer material can be again conveyed to the secondary transfer position without a toner image becoming deteriorated. That is, a toner image will not be wasted even if the necessity of a paper feed retry occurs.

A case has been described in Embodiment 1 where the present invention is applied when performing unicolor image formation. Embodiment 2 describes the case where the present invention is applied when performing color image formation. When the leading edge of a toner image on the intermediate transfer member 9 and the transfer material 2 respectively reach predetermined synchronous timings, the development rotary 23 is moved to the next development position in order to start forming an image of the next color. In other words, a developer of the next color moves to the development position. At the synchronous timings, formation of an image of the next color has started, and therefore development of at least two colors of toner images will be complete. If the transfer material 2 has not reached the paper re-feed waiting position 7 by the synchronous timings, or if there is no paper, conventionally, the toner images of the two colors will be discarded, which is a waste.

In view of this, in Embodiment 2, if the transfer material 2 has not been conveyed to the paper re-feed waiting position 7 before the development of a toner image of the first color finishes, transfer and superimposition of toner images of the second color and the following colors onto the intermediate transfer member is interrupted, and a paper feed retry is implemented. In particular, while transfer and superimposition is interrupted, the intermediate transfer member 9 continues rotating in the state where the toner image of the first color is carried on the intermediate transfer member 9. Thus, if the detection unit cannot detect a transfer material by a predetermined timing at which developing processing using the developing material of the first color finishes, developing processing or primary transfer using the developing materials of the second color and the following colors is interrupted. Then, if the detection unit detects a transfer material due to a retry performed by the feeding unit, the developing unit resumes developing processing or primary transfer using the developing materials of the second color and the following colors.

Figure 7:
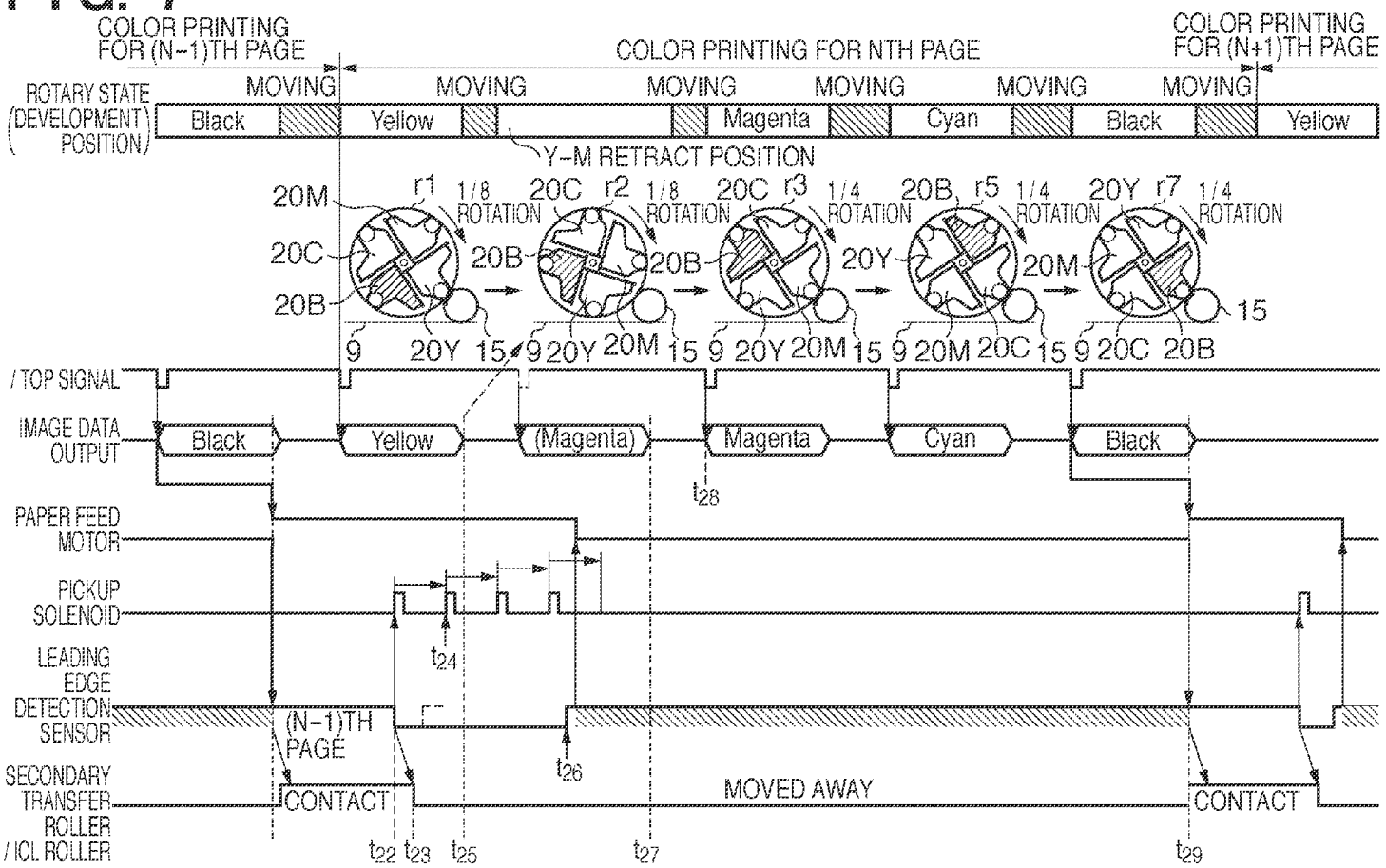
FIG. 7 is a timing chart showing color image formation according to Embodiment 2.

According to FIG. 7, the CPU 211 outputs the /TOP signal at an image formation timing (t21). The controller unit 201 starts outputting image data of the first color in synchronization with the /TOP signal. After that, at a timing (t22) when the trailing edge of the proceeding sheet of paper has passed the leading edge detection sensor, a paper feed operation starts by attraction of the pickup solenoid. At a timing (t23) when a transfer material has passed the secondary transfer unit, the secondary transfer roller 10 and the ICL roller 39 are moved away from the intermediate transfer member 9. If the leading edge detection sensor 6 cannot detect the transfer material 2 by a paper feed retry determination timing (t24), the CPU 211 implements a paper feed retry. Here, the paper feed retry is executed three times. The leading edge detection sensor 6 detects the transfer material 2 (t26), and the paper feed retry finishes.

Note that if the leading edge detection sensor 6 does not detect the transfer material 2 by a yellow (first color) development finish timing (that is, a developer change timing (t25)), the development rotary 23 rotates ⅛ of a full rotation, and thus the development rotary 23 is moved to the Y-M development retract position. If a paper feed retry of the transfer material 2 succeeds by a next developer change timing (t27), the development rotary 23 rotates ⅛ of a full rotation, and thus the magenta developer 20M is moved to the development position. The CPU 211 outputs the /TOP signal (t28). A paper feed retry is not performed in the case of the third and fourth colors. Thus, after image data of each color is output, the development rotary 23 rotates ¼ of a full rotation. Accordingly, transfer and superimposition (primary transfer to the intermediate transfer member 9) of different colors of toner images is executed.

The CPU 211 brings the secondary transfer roller 10 and the ICL roller 39 into contact with the intermediate transfer member 9 at a paper re-feed timing (t29), and conveys the transfer material 2 that was waiting at the paper re-feed waiting position 7 to the secondary transfer position by driving the paper feed motor 225. Accordingly, secondary transfer of a multicolor toner image to the transfer material 2 is performed.

Figure 8A:
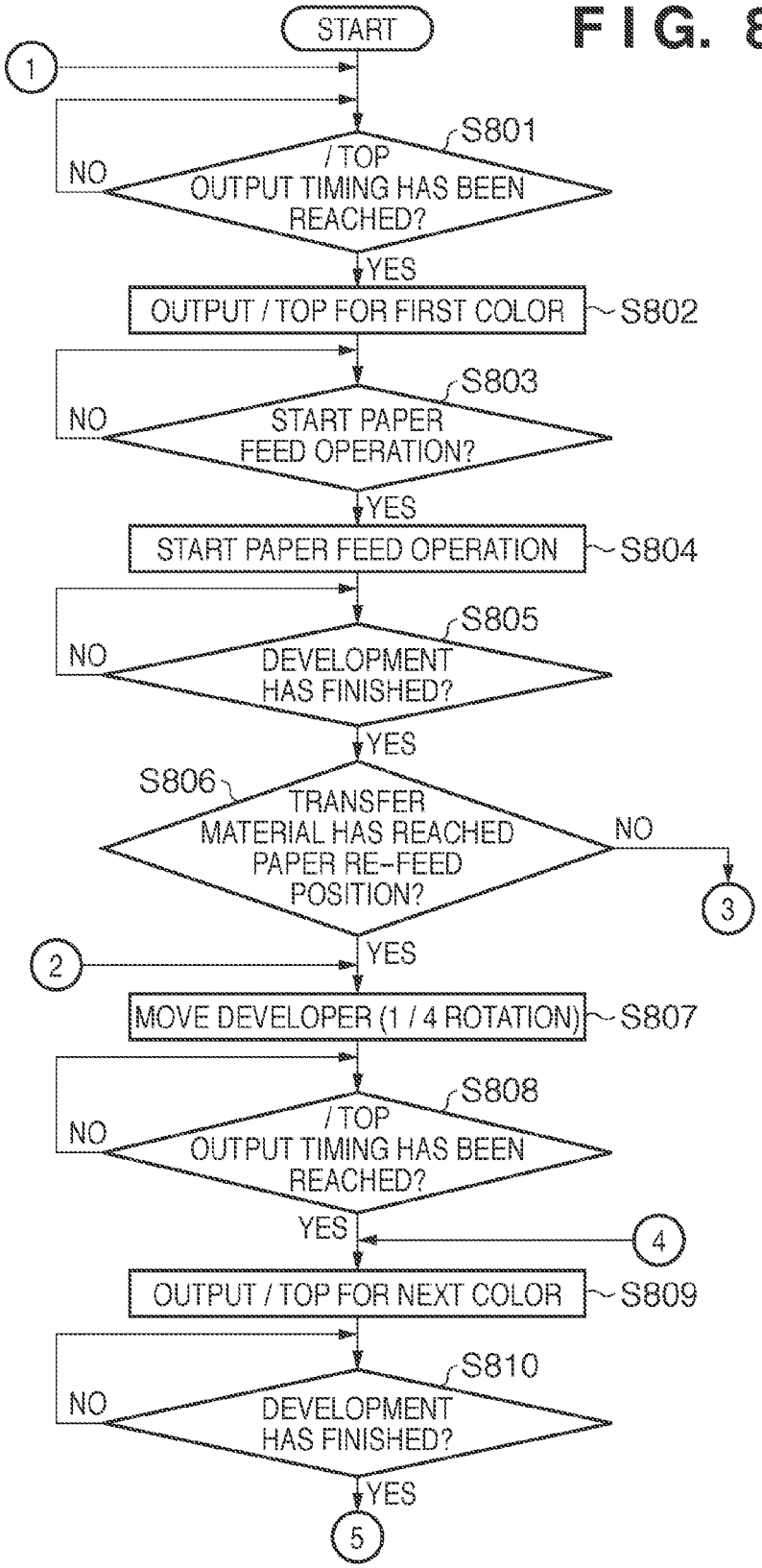
FIGS. 8A and 8B are flowcharts showing processing performed in Embodiment 2.
Figure 8B:
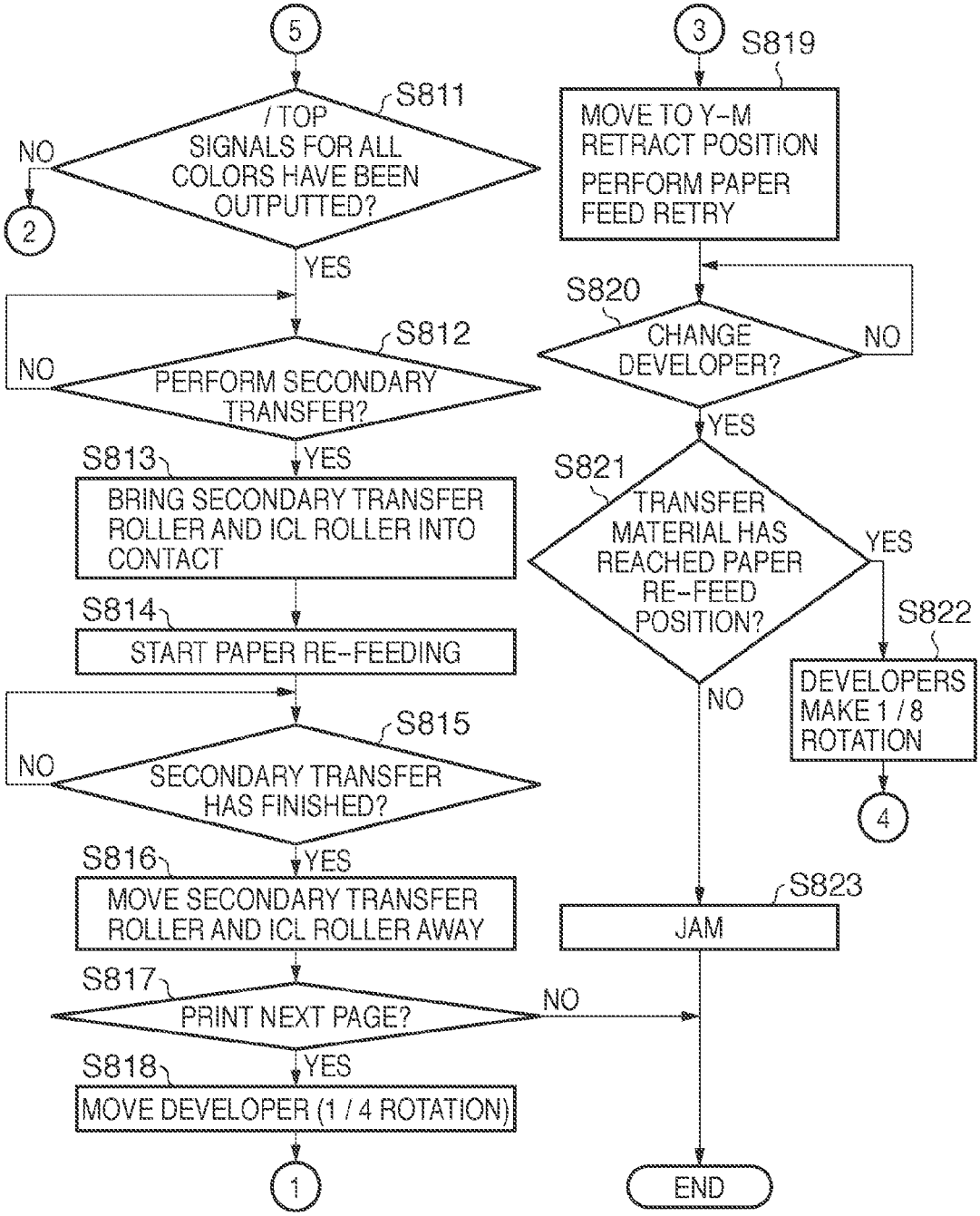

Next, a description is given with reference to FIGS. 8A and 8B. Note that a brief description is given on processing that is the same as or similar to the processing that has been described with reference to FIG. 6. In S801, the CPU 211 determines whether or not the /TOP output timing for the first color has been reached. If the /TOP output timing for the first color has been reached, the processing proceeds to S802. In S802, the CPU 211 outputs the /TOP signal 220 for the first color to the controller unit 201. In S803, the CPU 211 determines whether or not the paper feed operation start timing has been reached. If the paper feed operation start timing has been reached, the processing proceeds to S804. In S804, the CPU 211 starts a paper feed operation.

In S805, the CPU 211 determines whether or not a first color development finish timing has been reached. If the first color development finish timing has been reached, the processing proceeds to S806. In S806, the CPU 211 determines whether or not the transfer material 2 has reached the paper re-feed waiting position 7. If the transfer material 2 has reached the paper re-feed waiting position 7, in S807, the CPU 211 gives an instruction to the driving control unit 217 to cause the development rotary 23 to rotate ¼ of a full rotation. The driving control unit 217 causes the development rotary 23 to rotate ¼ of a full rotation using the main motor 219. Accordingly, the magenta developer 20M, which corresponds to the next color, moves to the development position. In 5808, the CPU 211 determines whether or not the /TOP output timing for the next color has been reached. If the /TOP output timing for the next color has been reached, the processing proceeds to S809. In S809, the CPU 211 outputs the /TOP signal 220 for the next color to the controller unit 201. In S810, the CPU 211 determines whether or not a next color development finish timing has been reached. If the development finish timing has been reached, the processing proceeds to S811. In S811, the CPU 211 determines whether or not the /TOP signals 220 for all the colors have been output. If development using a next color still needs to be performed, the CPU 211 repeats S807 to S811. Yellow (first color), magenta (second color), cyan (third color), and black (fourth color) toner images are transferred and superimposed onto the intermediate transfer member 9. In order to perform primary transfer of four colors of toner images, the intermediate transfer member 9 makes four full rotations (4 laps).

If it is determined in S806 that the transfer material 2 has not reached the paper re-feed waiting position 7, the processing proceeds to S819. In S819, the CPU 211 causes the development rotary 23 to rotate ⅛ of a full rotation, and thereby moves the developer 20Y to the Y-M development retract position. Further, the CPU 211 rotates the toner image that is carried on the intermediate transfer member 9 without transferring the toner image for one full rotation of the intermediate transfer member 9 by causing the intermediate transfer member 9 to make one full rotation. While this toner image is rotating without being transferred (making one full rotation without being transferred), the CPU 211 executes a paper feed retry.

In S820, the CPU 211 determines whether or not the developer change timing has been reached. The developer change timing is a timing at which the intermediate transfer member 9 has made one full rotation without transferring the toner image. If the developer change timing has been reached, the processing proceeds to S821. In S821, the CPU 211 determines whether or not the transfer material 2 has reached the paper re-feed waiting position 7. If the transfer material 2 has reached there, the processing proceeds to S822. Note that in S821, if the transfer material 2 has not reached the paper re-feed waiting position 7, the CPU 211 determines that a jam has occurred, and interrupts the image formation operation. In S822, the CPU 211 causes the development rotary 23 to rotate ⅛ of a full rotation. Thereby, the magenta developer 20M moves from the retract position to the development position. After that, the processing proceeds to S809, where the image formation operation resumes.

In S812, the CPU 211 determines whether or not the secondary transfer timing has been reached. If it has been reached, the processing proceeds to S813. In S813, the CPU 211 gives, to the driving control unit 217, an instruction to bring the secondary transfer roller 10 and the ICL roller 39 into contact with the intermediate transfer member 9. In S814, the CPU 211 executes re-feeding of the transfer material 2 that is waiting at the paper re-feed waiting position. In S815, the CPU 211 determines whether or not secondary transfer has been completed. Determination of whether or not secondary transfer has been completed is realized by a paper detection sensor (not shown) detecting that the trailing edge of the transfer material 2 has passed the secondary transfer position, for example. If secondary transfer has been completed, the processing proceeds to S816. In S816, the CPU 211 gives, to the driving control unit 217, an instruction to move the secondary transfer roller 10 and the ICL roller 39 away from the intermediate transfer member 9.

In S817, the CPU 211 determines whether or not a next page on which image formation is to be performed exists. If a next page exists, the processing proceeds to S818. In S818, the CPU 211 causes the development rotary 23 to rotate ¼ of a full rotation. Thereby, the developer 20Y of the first color reaches the development position again.

As described above, if the transfer material 2 is not conveyed to the prescribed position before first color development finishes, transfer and superimposition of toner images of the second color and the following colors to the intermediate transfer member 9 is once interrupted. During interruption, in the state where the toner image of the first color is held on the intermediate transfer member 9, the CPU 211 executes a paper feed retry. Thereby, the probability that the four colors of toner images are wasted greatly decreases.

The case has been described in Embodiment 2 where if the transfer material 2 is not conveyed to the paper re-feed waiting position 7 before first color development finishes, transfer and superimposition of toner images of the second color and the following colors to the intermediate transfer member is interrupted, and also a paper feed retry is implemented. Specifically, in Embodiment 2, it is determined whether or not to postpone transfer and superimposition to the intermediate transfer member 9 at the first color development finish timing (t25), and it is determined whether or not a jam has occurred at the second color development finish timing (t27). That is, it can be said that a paper feed retry is limited to being performed between the first color development finish timing and the second color development finish timing. However, there is a possibility that a paper feed retry succeeds by the third or following color development finish timing. In view of this, Embodiment 3 describes a case where it is determined whether or not transfer and superimposition is postponed at the second color development finish timing, and it is determined whether or not a jam has occurred at the third color development finish timing.

Figure 9:
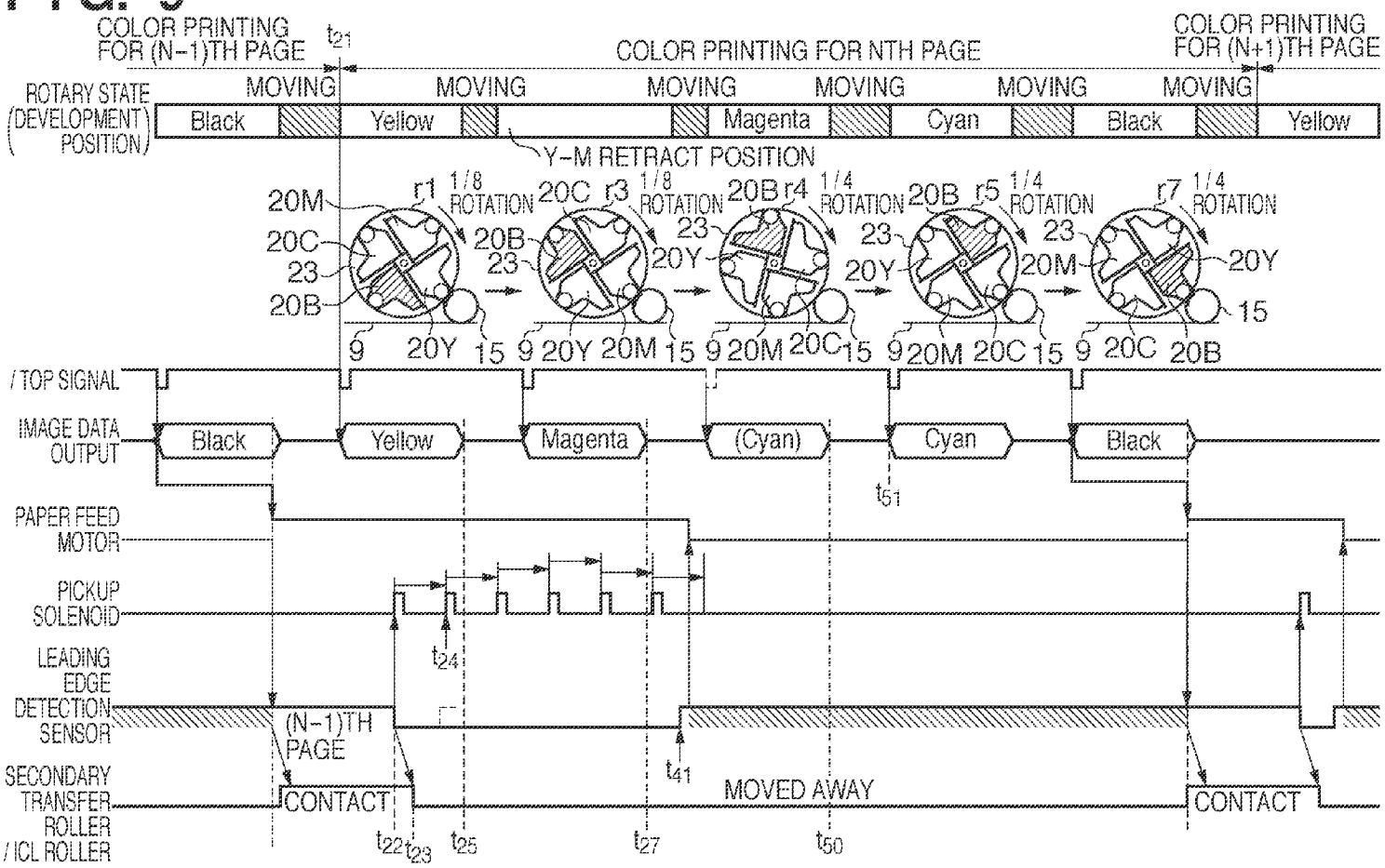
FIG. 9 is a timing chart showing processing performed in Embodiment 3.

Next, a description is given with reference to FIG. 9. The same reference numerals are given to portions that have already been described. Generally, the concept of Embodiments 2 and 3 is that in an image forming apparatus that forms a multicolor image using M colors of developers (M is a natural number), a paper feed retry is executed between transfer and superimposition of an Nth ($N \leq M-1$) color toner image and an N+1th color toner image, in the state where a superimposition image obtained by superimposing up to and including the Nth color toner image is held on the intermediate transfer member 9. Here, it is assumed that M=4, and N=2 or 3 in order to make the description easier to understand.

Since the leading edge detection sensor 6 was not able to detect the transfer material 2 by a paper feed retry determination timing (t24), the CPU 211 implements a paper feed retry. If the leading edge detection sensor 6 detects a transfer material during the paper feed retry (t41), the CPU 211 finishes the paper feed retry. On the other hand, the yellow (first color) development finishes (t25), and thereafter the CPU 211 causes the development rotary 23 to rotate ¼ of a full rotation, and thus moves the magenta developer 20M to the development position (r3). After that, the CPU 211 outputs the /TOP signal for the second color. The controller unit 201 outputs image data of the second color (magenta) in synchronization with the /TOP signal for the second color.

Here, by the magenta (second color) development finish timing (t27), the transfer material 2 does not reach the paper re-feed waiting position 7. That is, it is necessary to postpone transfer and superimposition of the third color toner image, and to execute a paper feed retry. The CPU 211 causes the development rotary 23 to rotate ⅛ of a full rotation, and thereby moves the development rotary 23 to an M-C development retract position (r4). The CPU 211 causes a superimposition toner image obtained by superimposing yellow and magenta toner images on the intermediate transfer member 9 to make one full rotation by causing the intermediate transfer member 9 to make one full rotation. At a change timing (t50) of changing to the cyan developer 20C again, the CPU 211 confirms whether or not the transfer material 2 is waiting at the paper re-feed waiting position 7. The change timing (t50) is set as the jam determination timing. If the transfer material 2 is waiting, the CPU 211 moves the cyan developer 20C to the development position (r5) by causing the development rotary 23 to rotate ⅛ of a full rotation, and outputs the /TOP signal for the third color (t51). Thereby, the image formation operation resumes. Further, the CPU 211 causes the intermediate transfer member 9 to make another full rotation, and outputs the /TOP signal for the fourth color (t52).

At the paper re-feed timing (1210), the CPU 211 brings the secondary transfer roller and the ICL roller into contact, conveys the transfer material that is waiting at the paper re-feed waiting position to the secondary transfer unit by driving the paper feed motor, and transfers a toner image on the intermediate transfer member to the transfer material (1236, 1238).

Figure 10A:
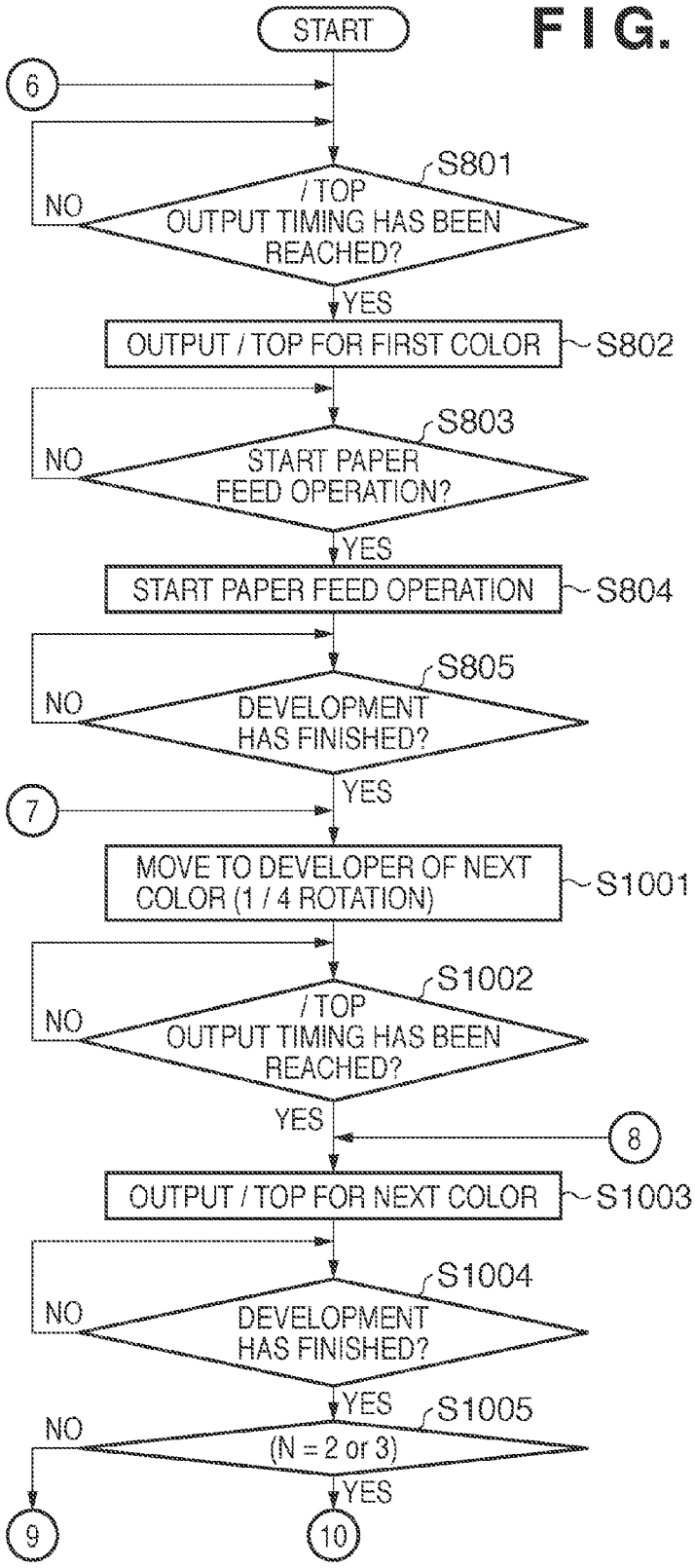

Next, a description is given with reference to FIGS. 10A and 10B. Note that the description is simplified by giving the same reference numerals to portions that have already been described. After processing in S801 to S805 (first color developing processing) is executed, the processing proceeds to S1001.

In S1001, the CPU 211 causes the development rotary 23 to rotate ¼ of a full rotation, and thereby moves the magenta developer 20M to the development position. In S1002, the CPU 211 determines whether or not the timing has been reached at which the /TOP signal for the next color is to be output. If the timing has been reached at which the /TOP signal for the next color is to be output, the processing proceeds to S1003. In S1003, the CPU 211 outputs the /TOP signal for the next color. In S1004, the CPU 211 determines whether or not the next color development finish timing has been reached. If the development finish timing has been reached, the processing proceeds to S1005. In S1005, the CPU 211 determines which color development in the order has finished. Specifically, the CPU 211 determines whether or not the color for which development has finished is a predetermined Nth color. If it is not the Nth color, paper feed retry determination is skipped, and the processing proceeds to S811. If it is the Nth (for example, second or third) color, the processing proceeds to S1006.

In S1006, the CPU 211 determines whether or not the transfer material 2 has reached the paper re-feed waiting position 7. If the transfer material 2 has reached the paper re-feed waiting position 7, the processing returns to S1001. Specifically, the CPU 211 causes the development rotary 23 to rotate ¼ of a full rotation, and thereby moves the developer 20C corresponding to the color after the next to the development position. A toner image of the color after the next is superimposed on the intermediate transfer member 9. After that, transfer and superimposition is executed until the Mth color toner image is transferred and superimposed.

On the other hand, if it is determined in S1006 that the transfer material 2 has not reached the paper re-feed waiting position 7, the processing proceeds to S1007. In S1007, the CPU 211 causes the development rotary 23 to rotate ⅛ of a full rotation. Accordingly, the development rotary 23 is positioned such that the development position comes between the Nth color developer and the N+1th color developer. In other words, the development rotary 23 moves to the development retract position between the Nth color developer and the N+1th color developer. Furthermore, the CPU 211 causes the intermediate transfer member 9 to make one full rotation without transferring a superimposition image in the state where the superimposition image obtained by superimposing up to and including the Nth color toner image is carried on the intermediate transfer member 9. The CPU 211 executes a paper feed retry during this rotation without transferring the superimposition image.

In S1008, the CPU 211 determines whether or not the /TOP output timing has been reached again. If the TOP output timing (developer change timing after causing the intermediate transfer member 9 to make one full rotation) has been reached, the processing proceeds to S1009. In S1009, the CPU 211 determines whether or not the transfer material 2 has reached the paper re-feed waiting position 7. If the transfer material 2 has not reached the paper re-feed waiting position 7, the processing proceeds to S823 (jam). On the other hand, if the transfer material 2 has reached the paper re-feed waiting position 7, the processing returns to S1003. At this time, the CPU 211 causes the development rotary 23 to rotate ⅛ of a full rotation, and thereby moves the N+1th color developer to the development position. Then, in S1003 and steps after that, transfer and superimposition of toner images of the N+1th color and following colors resumes.

According to Embodiment 3, if the detection unit cannot detect a transfer material by a timing at which developing processing using a developing material of the Nth color finishes, developing processing or primary transfer using the developing materials of the N+1th (N+1≤M) color and following colors is interrupted. Furthermore, if the detection unit detects a transfer material due to the retry executed by the feeding unit during the interruption, developing processing or primary transfer using the developing materials of the N+1th color and following colors is resumed. Accordingly, it is possible to decrease the probability that toner images of up to and including the Nth color that have been transferred and superimposed onto the intermediate transfer member 9 are wasted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-147006, filed Jun. 19, 2009 which is hereby incorporated by reference herein in its entirety.

What is claimed is:

1. An image forming apparatus, comprising:

an image carrier on which a latent image is formed;

a developing unit which develops the latent image;

a transfer member which carries an image developed on the image carrier;

a transfer unit which transfers the image carried by the transfer member to a recording material at a transfer position; and a feeding unit which feeds the recording material to the transfer position, wherein, in a case the recording material is not fed when an operation of feeding the recording material is tried, the developing unit moves to a position different from a developing position while the transfer member is carrying the image, and the feeding unit retries feeding of the recording material.

2. The image forming apparatus according to claim 1, wherein the transfer unit is capable of contacting with the transfer member and moving away from the transfer member, and wherein, in the case that the recording material is not fed when the operation of feeding the recording material is tried, the transfer unit moves away from the transfer member.

3. The image forming apparatus according to claim 2, further comprising:

a cleaning unit which cleans the transfer member, and is capable of contacting with the transfer member and moving away from the transfer member, wherein, in the case that the recording material is not fed when the operation of feeding the recording material is tried, the cleaning unit moves away from the transfer member.

4. The image forming apparatus according to claim 1, wherein the developing unit includes a plurality of developing members, and wherein the developing position is a position at which one of the plurality of the developing members is located to face the image carrier.

5. The image forming apparatus according to claim 4, wherein the plurality of the developing members includes a first developing member which develops the latent image using a first color developing agent and a second developing member which develops the latent image using a second color developing agent, and wherein, in the case that the recording material is not fed when the operation of feeding the recording material is tried, and the first developing member has not finished a developing operation, the second developing member aborts a developing operation.

6. The image forming apparatus according to claim 1, further comprising:

a sensor which senses that the recording material fed by the feeding unit reaches a predetermined position, wherein the predetermined position is before the transfer position in a conveyance direction, wherein the case when that the recording material is not fed when the operation of feeding the recording material is tried includes a case when the sensor cannot sense that the recording material fed by the feeding unit has reached the predetermined position.

7. The image forming apparatus according to claim 1, wherein the developing unit supports a plurality of developing members in a rotatable manner, and wherein the developing unit rotates the plurality of developing members to position one of the plurality of developing members to face the image carrier at a time.

8. The image forming apparatus according to claim 7, wherein, in the case that the recording material is not fed when the operation of feeding the recording material is tried, the developing unit rotates the plurality of developing members such that none of the plurality of developing members faces the image carrier.

9. The image forming apparatus according to claim 1, wherein the developing unit includes a developing member, and the developing unit develops the latent image by contacting with the image carrier.

10. The image forming apparatus according to claim 9, wherein the transfer member is rotatable while the transfer member carries the image, and wherein, in the case that the recording material is not fed when the operation of feeding the recording material is tried, the transfer member rotates while the transfer member carries the image, and the transfer member does not transfer the image at the transfer position.

11. An image forming apparatus comprising:

an image carrier on which a latent image is formed;

a developing member which develops the latent image formed on the image carrier;

a transfer member to which an image developed on the image carrier is transferred;

a transfer unit which transfers the image carried by the transfer member to a recording material; and a feeding unit which feeds the recording material to the transfer unit, wherein, in a case the recording material is not fed when an operation of feeding the recording material is tried, the feeding unit performs the operation of feeding again, the developing member is switchable between a contact state where the developing member contacts with the image carrier and a non-contact state where the developing member is not in contact with the image carrier, and when the feeding unit performs the operation of feeding again, the developing member switches to the non-contact state.

12. The image forming apparatus according to claim 11, wherein the image carrier and the transfer member rotate during an image formation operation for the recording material, and in the case the recording material is not fed when the operation of feeding the recording material is tried, the image carrier and the transfer member continue to rotate while the transfer member is carrying the image.

13. The image forming apparatus according to claim 11, wherein the transfer unit is capable of contacting with and separating from the transfer member, and in the case the recording material is not fed when the operation of feeding the recording material is tried, the transfer unit separates from the transfer member.

14. The image forming apparatus according to claim 11, further comprising a cleaning unit which cleans the transfer member and which is capable of contacting with and separating from the transfer member, and in the case the recording material is not fed when the operation of feeding the recording material is tried, the cleaning unit separates from the transfer member.

15. The image forming apparatus according to claim 11, further comprising a sensor which senses that the recording material reaches a predetermined position which is located upstream of a transfer position with respect to a conveyance direction of the recording material, and the image is transferred from the transfer member to the recording material, and wherein a state where a recording material is not fed from a storage when the operation of feeding the recording material is tried is a state where the sensor does not sense the recording material after a predetermined time has elapsed since the operation of feeding is tried.

16. The image forming apparatus according to claim 11, wherein the image carried on the transfer member is an image corresponding to the recording material which is not fed in the operation of feeding, the feeding unit performs the operations of feeding the recording material again, and the transfer unit transfers the image to the recording material fed by the feeding unit.

17. The image forming apparatus according to claim 11, wherein the developing member includes a plurality of developing elements, images of different colors are formed on the image carrier by the developing elements, and the transfer member carries the images of different colors in a superposed manner.

* * * * *